US005331774A

United States Patent [19]

Domenella

[11] Patent Number: 5,331,774

[45] Date of Patent: Jul. 26, 1994

[54] METHOD AND DEVICE FOR SHARPENING CHIRAL BLADES OF DENTAL INSTRUMENTS

[76] Inventor: David D. Domenella, 9906 N. Rte. #14, Harvard, Ill. 60033

[21] Appl. No.: 908,038

[22] Filed: Jul. 9, 1992

[51] Int. Cl.[5] ..... B24B 1/00

[52] U.S. Cl. ..... 51/285; 51/98 BS; 51/98.5

[58] Field of Search ..... 51/98 R, 98 BS, 92 R, 51/93, 94 R, 96, 102, 165.74, 218 R, 220, 224, 231, 217 S, 285, 98.5

[56] References Cited

U.S. PATENT DOCUMENTS

| | | | |
|---|---|---|---|
| 1,391,763 | 9/1921 | Dickenson | 51/17 |
| 1,689,770 | 10/1928 | Briley | 269/210 |
| 2,911,771 | 11/1959 | Amiet | 51/102 |
| 3,098,327 | 7/1963 | Malin | 51/229 |
| 3,135,073 | 6/1964 | Odle | 51/229 |
| 4,106,240 | 8/1978 | De Bartolo | 51/229 |
| 4,769,955 | 9/1988 | Reiling | 51/218 A |
| 4,821,462 | 4/1989 | Moore | 51/214 |
| 5,058,324 | 10/1991 | Snellen | 51/229 |
| 5,107,935 | 4/1992 | McBride | 269/270 |

*Primary Examiner*—M. Rachuba
*Attorney, Agent, or Firm*—Greer, Burns & Crain, Ltd.

[57] ABSTRACT

A device for sharpening a dental instrument has a housing with a clamp movably mounted on the housing. The clamp fixes a dental tool in a holding device at a predetermined position. The dental tool is then sharpened on a fixed, but rotatable sharpening stone. The precision sharpening device includes at least one vertically fixable tool holding mount, and at least one fixed holding post to permit the tool holding mount to rotate horizontally to the sharpening stone.

5 Claims, 6 Drawing Sheets

FIG. 2
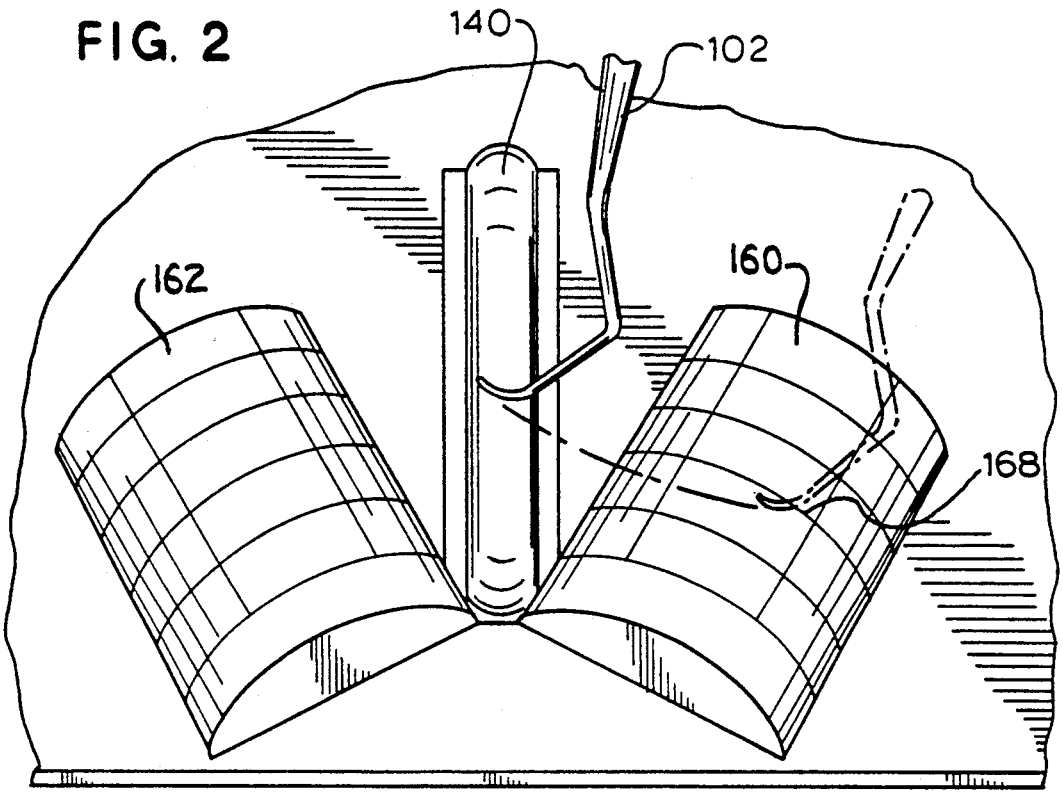
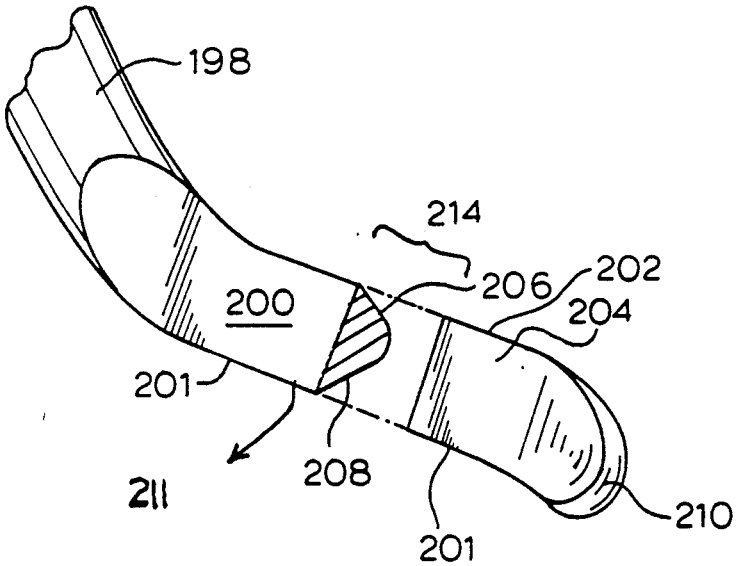
FIG. 3

FIG. 8
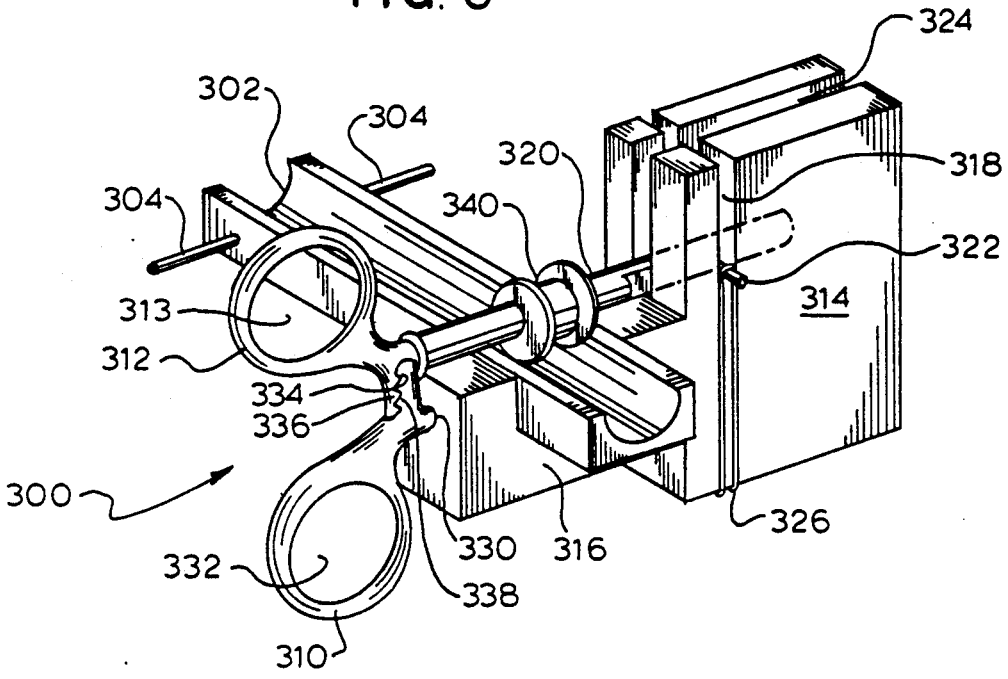
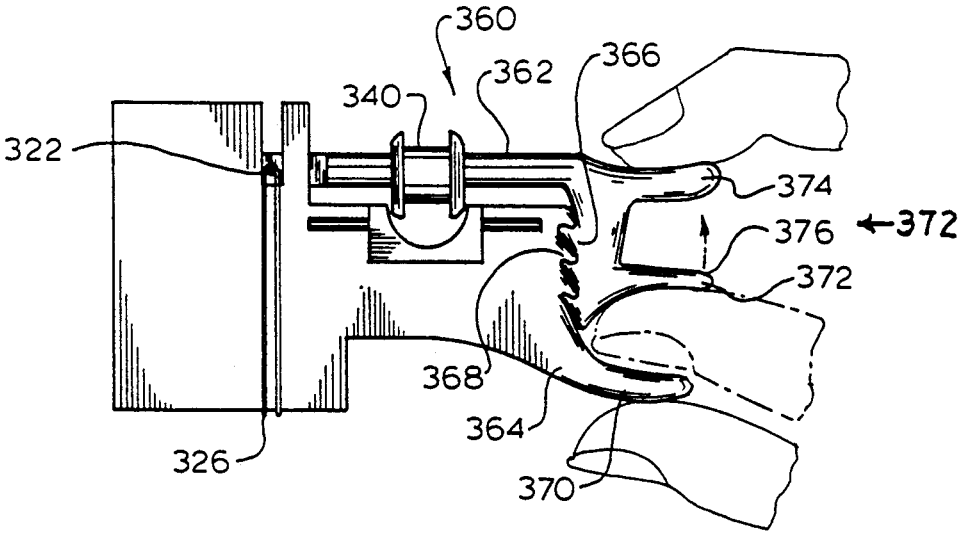
FIG. 9

FIG. 10
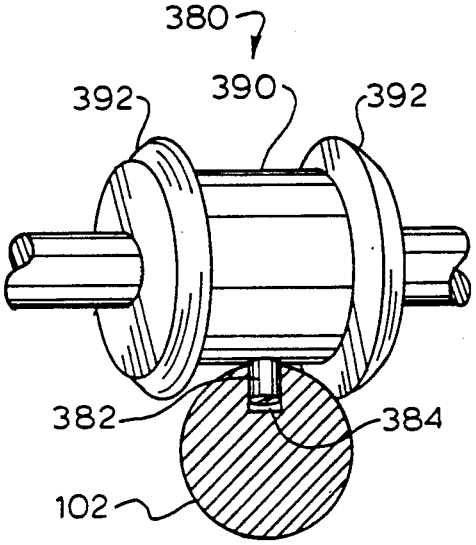
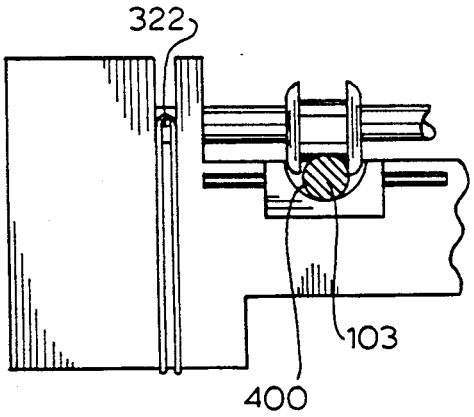
FIG. 11
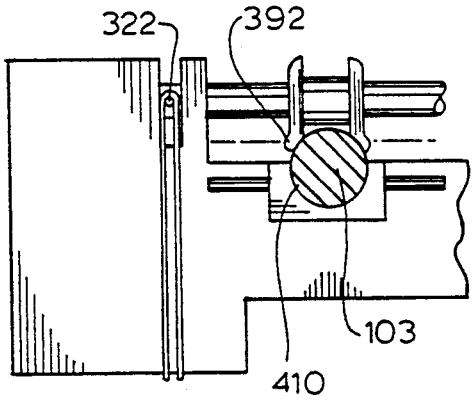
FIG. 12

METHOD AND DEVICE FOR SHARPENING CHIRAL BLADES OF DENTAL INSTRUMENTS

The invention relates to a sharpening device, and more particularly to a device for sharpening a dental instrument, the device having a separate, repetitively determinable, fixed sharpening position for each instrument.

BACKGROUND OF THE INVENTION

Gum disease is now a very prevalent human health problem. Left untreated, gum disease can cause a substantial health problem. Partial or complete loss of teeth can result from gum disease, with associated pain and discomfort therefrom. Lost teeth are, of course, a major health problem. To treat the gum disease problem, periodontal procedures are applied.

To carry out periodontal procedures, a dentist is required to use special curettes. There are many different types of curettes. The curette is used to remove hardened deposits below a patient's gum line. Each curette needs to be very sharp, in order to remove these deposits. Each instrument is designed with a different blade angle, depending on the area of the patient's mouth in which the hygienist or dentist is working. The cutting edge of an instrument is angled or otherwise varied in this respect. When sharpening an instrument, it is very important to preserve the shape and angle of the blade.

Uniform removal of metal is important, because otherwise, the shape of the instrument can be changed; especially with regard to the angle of the lateral surface relative to the surface of the face. With few exceptions, only one cutting edge per tip of an instrument and only one lateral side must be ground during sharpening. The other lateral side is ground on a few designs of curettes, for example a sickle or a universal.

So therefore, in order to sharpen each instrument, a machine must be designed to provide a precise and a very accurate angle for each instrument. By precise is meant that the same angle on each particular instrument must be produced every time it is sharpened. Each instrument has a different angle, for different uses in different areas of the mouth.

It is highly desirable, even required, to have sharp instruments. Still it is just too costly to replace an instrument, merely because it is dull. Yet a sharpening device to precisely produce the desired sharp edge at the desired angle is not known. In fact, there is no known sharpening device for this purpose.

All currently known sharpening devices inherently rely on the operator's hand to hold the instrument to be sharpened in the proper position with respect to the sharpening stone. This factor creates a major problem, because the position of the operator's hand may change by as much as ten degrees without knowledge thereof by the operator. This factor causes an uneven removal of the lateral surface of the instrument, making the entire sharpening process very time consuming, inefficient, and tedious.

One known sharpening device requires placing the instrument on an abrasive surface, and vibrating the instrument very rapidly back and forth thereon. The hygienist, dentist or assistant places the instrument on the stone, and attempts to angle the instrument parallel to the line of the blade. This procedure is extremely tedious because the instrument usually has a round handle; and the lateral surface of the instrument, which needs to be removed in order to grind a cutting edge, has a varying angle. The angle of some instruments varies so often, that this sharpening procedure using this device just does not work to uniformly sharpen an instrument with the required accuracy.

Another known sharpening device has angles marked on a protractor-like scale for use with each instrument to be sharpened. The defect in this instrument is that it depends on a person being able to provide the same angle with his or her hand. Unfortunately, by human error, especially without a highly skilled person doing the sharpening, this device is inherently inadequate for producing the same surface on an instrument, because the lateral surface is only about one millimeter to two millimeters in width, and which needs to be preserved in order to keep the instrument in good working condition.

SUMMARY OF THE INVENTION

Therefore, it is an objective of this invention to provide a device for uniformly sharpening a dental instrument.

A further objective of this invention is to provide a device for properly honing a lateral surface of a dental instrument.

A still further objective of this invention is to provide a device for properly maintaining the angle of the dental instrument.

Yet a further objective of this invention is to provide a device for properly sharpening a dental instrument, which minimizes human error.

Also an objective of this invention is to provide a device to reduce replacement of a dental instrument.

Another objective of this invention is to provide a device for uniformly sharpening a periodontal instrument.

Yet another objective of this invention is to provide a device for properly honing a lateral surface of a periodontal instrument.

Still another objective of this invention is to provide a device for properly maintaining the angle of a periodontal instrument.

A further objective of this invention is to provide a device for properly sharpening a periodontal instrument, which minimizes human error.

A still further objective of this invention is to provide a device to reduce replacement of a periodontal instrument.

Yet a further objective of this invention is to provide a method for properly sharpening a periodontal instrument, which minimizes human error.

Also an objective of this invention is to provide a method for properly honing a lateral surface of a periodontal instrument.

A still further objective of this invention is to provide a method for properly maintaining the angle of a periodontal instrument.

Yet a further objective of this invention is to provide a method for properly sharpening a periodontal instrument, which minimizes human error.

Also an objective of this invention is to provide a method to reduce replacement of a periodontal instrument.

These and other objectives of this invention (which other objectives become clear by consideration of the specification, claims and drawings as a whole) are met by providing a sharpening device with a clamp for fixing a dental tool in a holding device at a predetermined position. The dental tool is then sharpened on a fixed, but rotatable sharpening stone. The precision sharpening device includes at least one vertically fixable tool holding mount, and at least one fixed holding post to permit the tool holding mount to move horizontally to the sharpening stone. The tool mount cooperates with the clamp to achieve the desired result. A positioning guide may also be used to determine the locking position of the tool in the clamp prior to moving the tool to the sharpening stone.

BRIEF DESCRIPTION OF THE DRAWINGS

FIG. 2 depicts a portion of a top, plan view of dental instrument sharpening device 100 of this invention showing two positioning guides wherein a dental instrument is positioned with respect to one of the positioning guides.

FIG. 3 depicts a perspective view of a blade of a dental instrument 102.

FIG. 8 depicts an instrument holding device with a scissors clamp 300.

FIG. 9 depicts the instrument holding device with a squeeze clamp 360.

FIG. 10 depicts a perspective view of the rubber mounting grommet 380 with an index pin 382 for locating or positioning the instrument.

FIG. 11 depicts a view of a small handled instrument and its location within a clamp.

FIG. 12 depicts a view of a larger handled instrument and its location within a clamp.

Throughout the figures of the drawings, where the same part appears in more than one figure of the drawings, the same number is applied thereto.

DESCRIPTION OF THE PREFERRED EMBODIMENTS

Figure 1:
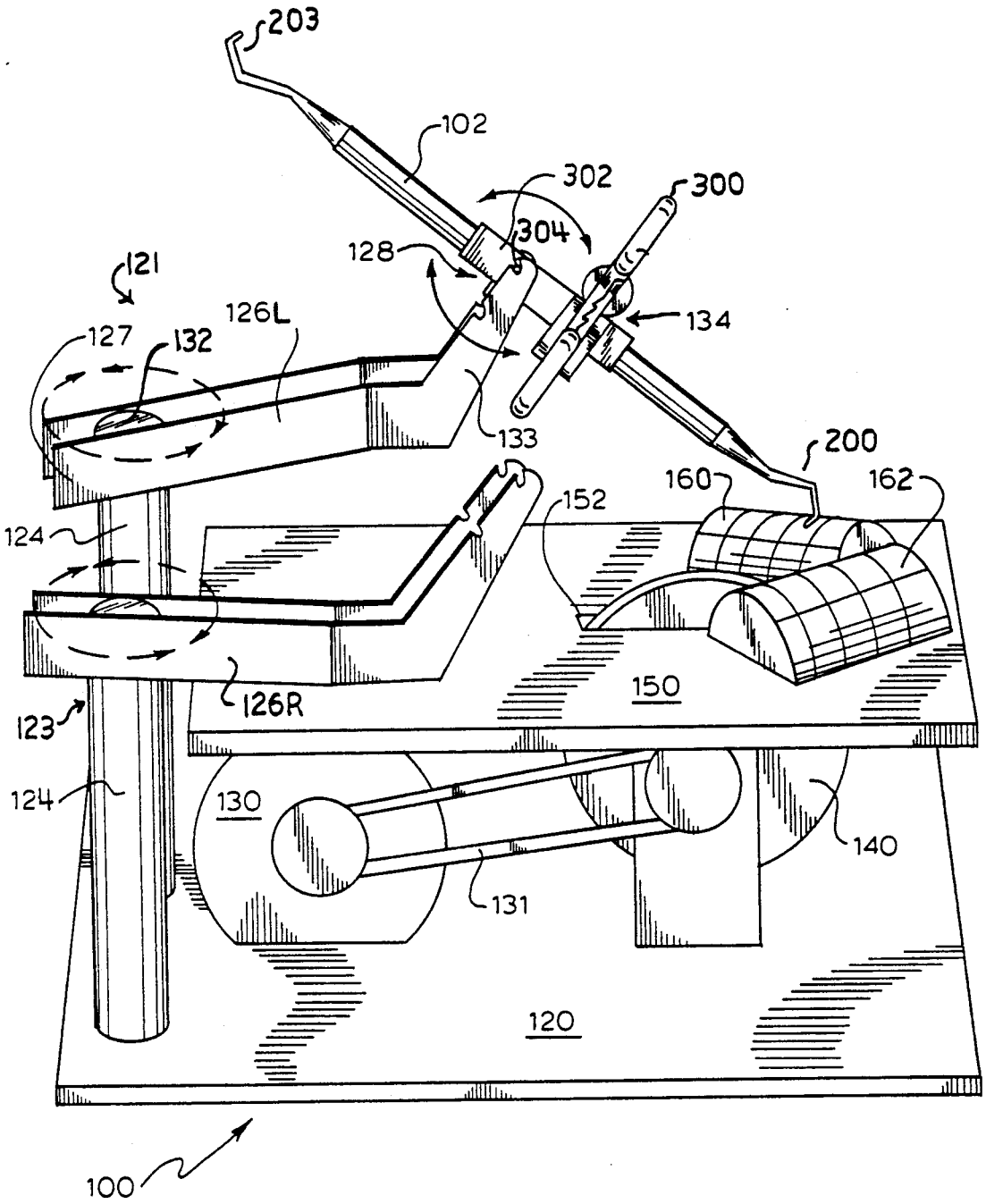
FIG. 1 depicts a side, top, perspective view of dental instrument sharpening device 100 of this invention.

In order to describe the dental instrument sharpening device in technical detail, certain geometrical postulates must be established so as to simplify the use or exploration of the device. This dental instrument sharpening device is very specifically dedicated to sharpening a dental curette which is used by a dentist in periodontal procedures. Each instrument needs to be very sharp. Also, each instrument is designed with a different angle for its blade (or cutting or scraping surface) depending on which area of the patient's mouth the instrument is used. Furthermore, the cutting edge, in some instruments, has a plurality of different angles within the same blade.

The cutting edge of the instrument is that which is formed by two surfaces. Sharpening of the edge is done by grinding one of those surfaces. The most desirable result being that the original orientation of the ground surface to the rest of the object being sharpened is preserved each time. This orientation of the ground surfaces will be referred to herein as the angle.

The cutting edge of the curette is determined by which edge of the curette is encountered by the tooth surface when the instrument is pulled over the tooth in the direction of the cutting action (as shown by arrow 211 in FIG. 3). Most types of curettes only have one cutting edge per end. Curettes are generally double-ended with the designs of the two ends being mirror images of each other having chirality. Therefore, the device described herein has a right positioning guide and a left positioning guide, each of which are essentially mirror images of each other; one positioning guide to sharpen one end of an instrument and the other positioning guide to sharpen the other end.

In order to sharpen an instrument properly, an instrument sharpening device or machine must provide a precise and very accurate angle. By precise is meant that the same angle on that particular instrument is produced every time it is sharpened. By accuracy is meant that the same angle as originally manufactured on that instrument is preserved as that instrument is sharpened.

The device described here positions the instrument in a correct three dimensional position by using two positioning criteria simultaneously. The basis of the sharpening device is the linear, tangential qualities of the guidance system. Thus, the guidance system is a linear tangential guide, because it is linear and tangential. First the instrument is placed linearly on the guide, while in the instrument clamp. The instrument is then locked in place by the instrument clamp to restrict its longitudinal movement and to achieve a tangential position with respect to the guide.

The guide provides an empirical scale, which is used to determine proper position for each instrument. A new or otherwise perfectly sharpened instrument is placed in the clamp and in proper contact with the sharpening stone. This new instrument is then moved to the guide. The point y contact by the instrument on the guide is then permanently marked in a suitable fashion for that instrument.

Within the instrument and the clamp, an appropriate second type of positioning guide is practical. The clamp may have a fixed pin therein. A fixed indentation on the handle of each instrument combines with the pin to properly position the instrument for application to the sharpening stone. With this feature present, the previously discussed positioning guide becomes optional.

When a dull instrument of the same type is desired to be sharpened, that dull instrument is placed in the clamp with the edge desired to be sharpened in contact with the guide at the marked position. The dull instrument is then secured in the clamp and the preferred sharpening position is achieved in the clamp.

Then the clamped instrument is moved horizontally from its position on the positioning guide to the sharpening wheel. At that point the blade of instrument forms a tangent to the grinding wheel at the desired sharpening angle. The tangent, that is the line that is tangent with the grinding wheel, is actually where the lateral surface of the sharpened instrument will be, and is where the lateral surface is being produced on the end of the instrument.

The device described here most preferably uses about a 5.1 centimeter (two inch) diameter Arkansas Stone, which operates at high speed in the direction noted in the drawings. Other stone sizes are suitable with appropriate adjustments in other dimensions of the device, but this one is preferred. Grinding of the lateral surface in order to produce the sharp cutting edge is done with the cutting edge lying across the wheel substantially perpendicular to the geometric plane of the wheel.

Therefore, technically the sharpening device is actually placing a new lateral surface on the instrument which is a concave surface and not actually a flat surface. However, due to the fact that the curettes normally sharpened with the device are only about 1.5 millimeter in width, the concave curvature is negligible, and the lateral surface produced by the device will be considered to be planar. During sharpening, the lateral surface will be at an angle that is tangent to the circumference of the wheel at the center of the area of contact by the lateral surface of the instrument.

The posts may be made of any suitable material. The posts receive the instrument arm in slidable fashion. The instrument arm includes a cylinder at one end thereof, and an instrument clamp at the other end thereof. The cylinder, which slides over the posts and positions the instrument clamp, permits the instrument arm to move horizontally. However, it is a tight fit permitting both free movement and a fixed position around a vertical axis.

In this fashion, the instrument can be moved from the graduated semicylindrical positioning guide to the instrument wheel. The graduated device positions the instrument for locking in the clamp. In this fashion, the instrument can be applied to the grinding wheel in substantially the same position every time. Thus, the edge on the instrument is maintained as desired.

One end of the instrument is sharpened in the first clamp. The second end is sharpened in the second clamp on the other post. There is usually only one cutting edge on each end of the instrument. This structure of the sharpening device is very simple, but very very effective. As the instrument is moved longitudinally in the clamp (when the clamp is not tightened), the angle of sharpening changes on the grinding wheel. Thus, any angle of blade of any curette can be sharpened in this device.

Turning now to FIG. 1, FIG. 2, FIG. 3, and FIG. 4 the dental instrument sharpening device 100 of this invention includes a base 120 having an electric motor 130 and grinding wheel 140 secured thereto in a standard fashion. Mounted above the base 120 and substantially parallel thereto is guidance platform 150. Within the guidance platform 150 is a grinder slot 152 capable of receiving grinding wheel 140. Grinder slot 152 is of sufficient size to permit grinding wheel 140 to enter therein and protrude therefrom without touching guidance platform 150. The grinding wheel 140 is powered by the electric motor 130 due to a standard connection therewith by belt 131.

Also mounted on the base 120 are a first post 122 and a second post 124. First post 122 and second post 124 are each mounted so that with respect to an imaginary center-line 142 the device 100 has a left portion 121 and a right portion 123 which are substantially mirror images of each other. When viewing FIG. 1, grinding wheel 140 rotates in a clockwise fashion.

To elaborate, the parts of the instrument 102 as displayed in FIG. 3 must be defined. Instrument 102, such as for example a curette 198, includes chiral blades 200 and 202. The first cutting edge 201 of blade 200 is that which is formed between the face 204 and the first lateral surface 208. If the end 210 of the curette 198 is pointed, it is called the tip. If the end 210 of the curette 198 is rounded, it is called the toe. FIG. 3 depicts end 210 as a toe.

The typical curette 198 shown in FIG. 3 has a toe at end 210. In the central region 214 of the curette 198 are the first cutting edge 201 and the second cutting edge 202. First cutting edge 201 is formed at face 204 and lateral surface 208. Second cutting edge 202 is formed at face 204 and second lateral surface 206. The curette 198 includes blade 200. The cutting action is indicated as moving away from the end 210 (as shown by the arrow 211 in FIG. 3).

The process of sharpening the first cutting edge 201 involves the uniform removal of metal from the first lateral surface 208. As can be seen in FIG. 3, second lateral surface 206 terminates in second cutting edge 202. Uniform removal of metal is important, because otherwise its shape is changed—especially the angle formed by the first lateral surface 208 and the surface of the face 204. With few exceptions, only first cutting edge 201 per blade 200 of an instrument 102 and only one lateral surface must be ground during sharpening. The second lateral surface 206 is ground on a few designs of curettes, for example, sickles and universals.

Figure 4:
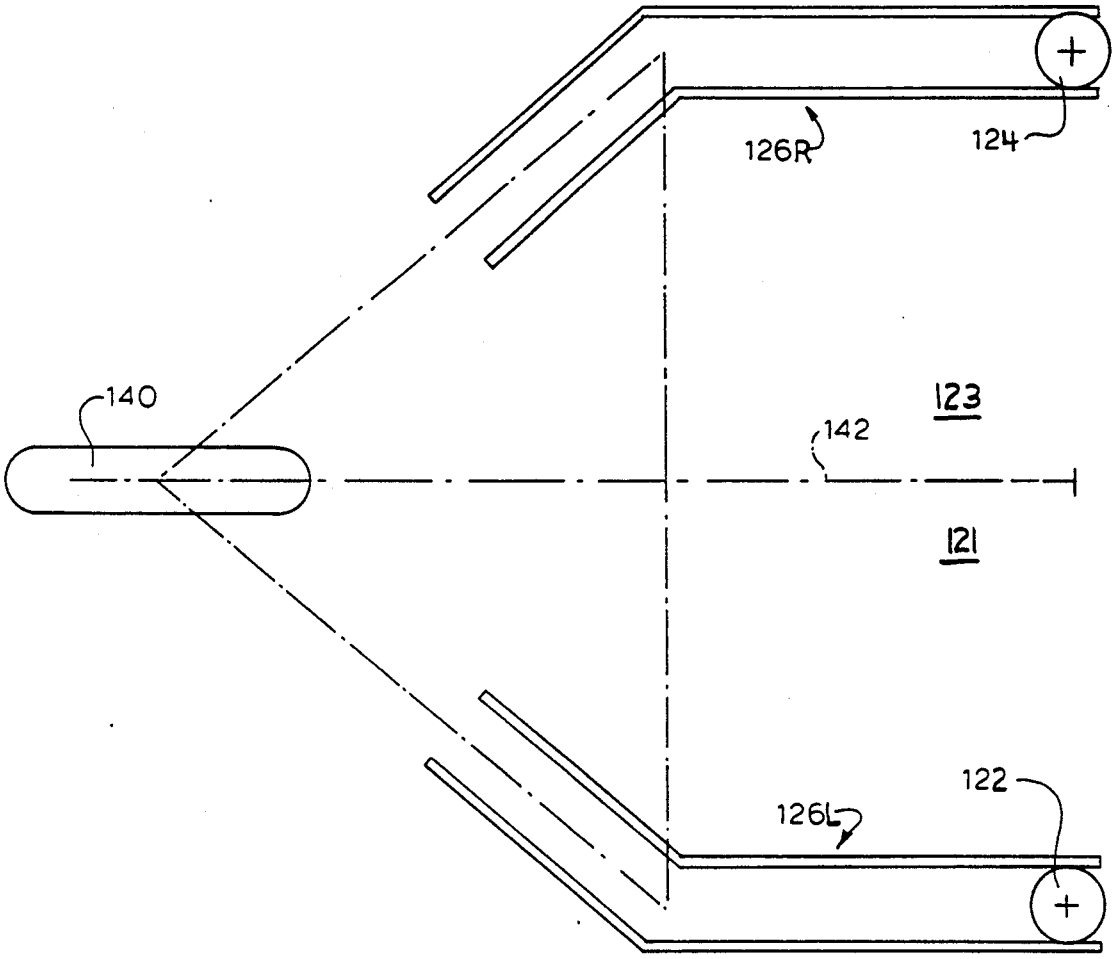
FIG. 4 depicts a top, plan view of dental instrument sharpening device 100 of this invention generally depicting the fixed holding posts and grinding wheel.

When considering FIG. 1 and FIG. 4, first post 122 and second post 124 are each rigid members capable of receiving instrument arms 126L and 126K respectively. It will be recognized that the instrument arm 126R may be used in the same manner as instrument arm 126L shown in FIG. 1.

Referring now to FIG. 1, explanation will be made with reference to the left portion 121, however, it will be recognized that a same description applies to the right portion 123. Instrument arm 126L has a post end 127 and a clamp end 128. Post end 127 generally includes a hollow cylinder 132 capable of slid ably mounting over first post 122 in a pivotal fashion. Instrument arm 126L rotates horizontally, but is fixed vertically.

Opposite post end 127 is an instrument receiving arm 133. Pivotally mounted within instrument receiving arm 133 about a horizontal axis (formed by pins 304, to be described with reference to FIG. 8) is instrument clamp 134. When a dental instrument, such as instrument 102, is placed in instrument clamp 134, the instrument 102 may be fixedly secured therein. Appropriate positioning of the instrument 102 creates correspondence between the blade 200 to be sharpened and indicia on either first positioning guide 162 or second positioning guide 162. Once so positioned, the instrument is locked in clamp 134 by hand tightening or other suitable means, so that movement thereof is horizontal, about the first post 122 that is to grinding wheel 140 for sharpening; and vertical in up down fashion about the horizontal axis to permit proper contact with both the grinding wheel 140, and indicia 168 on first positioning guide 160.

Indicia 168 are determined empirically and marked permanently on either first positioning guide 160 or second positioning guide 162. Indicia 168 are made by a standard dental pigment, such as an oxide coating. Another method may also be used to make indicia 168.

Adjacent the grinding wheel 140 on either side thereof, on raised platform 150, is first positioning device 160 and a second positioning guide 162. The first positioning guide 160 and second positioning guide 162 are preferably semicylindrical in shape, and may have graduated indicia thereon such that indicia on one positioning guide is a mirror image of indicia on the other positioning guide as shown in FIG. 1.

Flat positioning guides are also operable. But the flat device does not have the capacity to record the axial position of the clamped instrument. Axial positioning is discussed below.

It is feasible to take a sharpened instrument 102 and place the appropriate edge of the sharpened instrument 102 or new instrument 102 on the positioning guide. At that point an empirical mark is created for the instrument 102 on either positioning guide. Thus, when an instrument 102 of the same type is desired to be sharpened, it may be secured in the clamp and fixably mounted in the same position.

In this fashion, movement rotation of the clamped instrument 102 from a scale or a predetermined point on the appropriate positioning guide to the grinding wheel 140 keeps the instrument 102 in perfect position for sharpening. In this fashion, the angle and desired setup of the instrument 102 is maintained. The positioning member of the arm 122L permits the instrument 102 to be moved from the indicia on first positioning guide 160 onto the grinding wheel 140. The second positioning guide 162 permits the other end of the instrument 102 to be sharpened when the instrument is in a clamp on 126R. Thus, with the fixed height of the instrument receiving arm 133 the horizontal movement thereof the fixed horizontal axis of pins 403, and the clamp 134, the clamped instrument 102 is fixedly mounted and permitted to be sharpened in a desired fashion.

The device 100 positions the instrument 102 in a correct three dimensional position for sharpening by using two positioning criteria simultaneously:

(1) longitudinal (or linear) positioning and (2) axial positioning.

These two positioning elements provide for a simplified device 100.

By longitudinal positioning is meant that the instrument 102 can be locked in place by the clamp 134 at any position along its length. The position of the point of contact to the abrasive grinding wheel 140 changes as the linear position is changed. At each different linear position, a different tangential angle is created between the grinding wheel 140 and the instrument 102, and therefore a different angle may be imparted to the instrument 102.

Axial positioning refers to the rotated position of the instrument 102 along its axis or handle. Rotating the handle (or central portion between the two ends) of the instrument 102 changes its axial position. That position is determined on the first positioning guide 160 or second positioning guide 162 by virtue of the semicylindrical shape of the positioning guide.

In order to consistently produce the same surface on the instrument 102 during each sharpening cycle, the instrument 102 must be fixed at the same position. The two positioning criteria are recorded simultaneously by marking first positioning guide 160 or second positioning guide 162 as below described for each instrument 102 to be sharpened. A very precise positioning of the instrument 102 can be accomplished by always placing the same point of the instrument 102 on the same, empirically-determined point on first positioning guide 160 or second positioning guide 162.

The operator of the device 100 can choose any point on the blade 200 of the instrument 102 that he or she wishes to use as a visual reference point as long as that same visual reference point is used thereafter in subsequent sharpening cycles. By experience, through empirical testing for each of instrument 102, the best positioning technique is to position the central region of the blade (as indicated in FIG. 3 at central region 214) directly on one predetermined point designated as the indicia or the guide point for that particular design of an instrument 102 so that the first lateral surface 208, or cutting edge 201, the horizontal movement thereof of the instrument 102, is tangential to the circular shape of the guide.

After establishing the guide points all other instruments of the same design to be sharpened are locked in place on the liner tangential guide so that the central region of the blade 200 makes contact with that same predetermined point on the appropriate positioning guide 160 or 162. It can then be moved to the grinding wheel to be sharpened in the proper position by the pivoting of arm 126L about its vertical axis as described earlier.

The instrument 102 or specifically curette 198 is then placed in clamp 134 and in contact with its predetermined point. Then the instrument 102 is locked in place securely so that it will not move in clamp 134 while instrument 102 is being sharpened. The clamped instrument 102 may then be moved and placed in contact with the abrasive grinding wheel 140 for sharpening.

Figure 5:
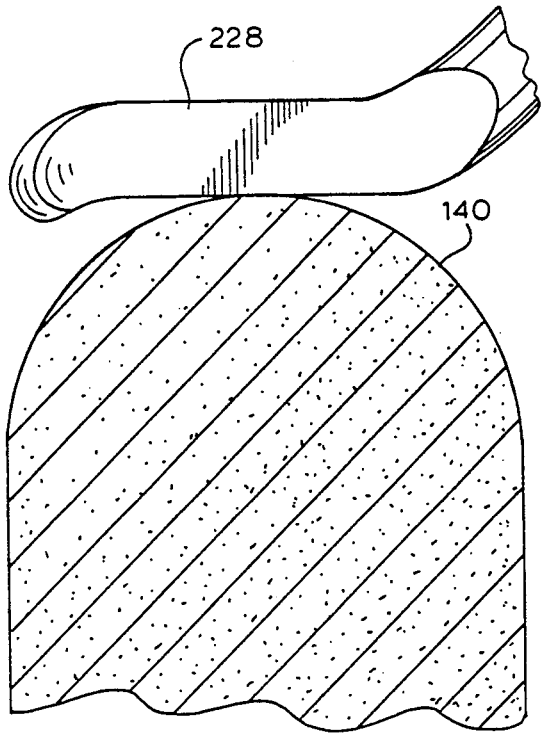
FIG. 5 depicts an end view of grinding wheel 140 of dental instrument sharpening device 100 of this invention having instrument 102 in proper axial position 228 on grinding wheel 140.
Figure 6:
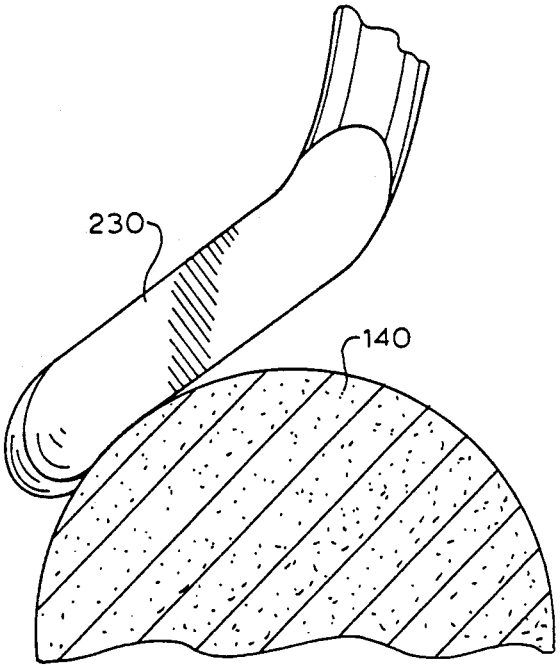
FIG. 6 depicts an end view of grinding wheel 140 of dental instrument sharpening device 100 of this invention having instrument 102 in improper counterclockwise position 230 on grinding wheel 140.
Figure 7:
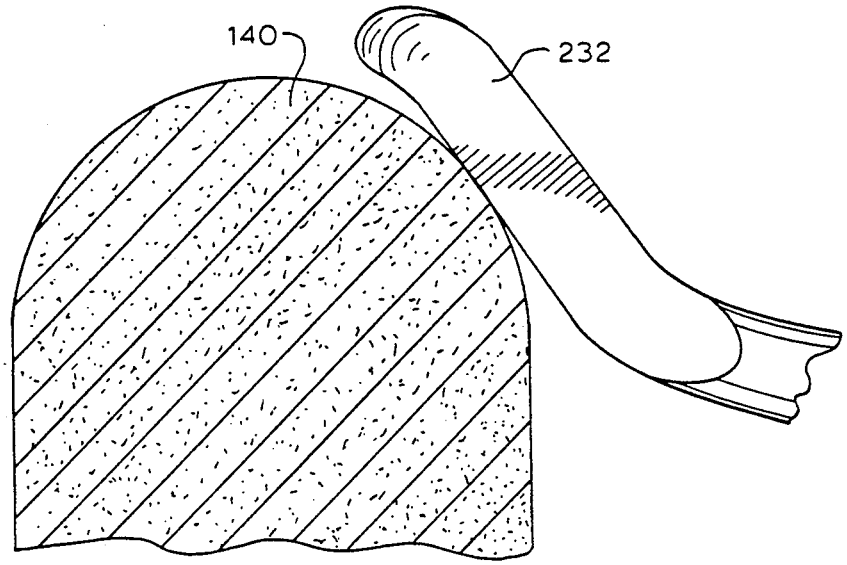
FIG. 7 depicts an end view of grinding wheel 140 of dental instrument sharpening device 100 of this invention having instrument 102 in improper clockwise position 232 on grinding wheel 140.

Referring now to FIG. 5, FIG. 6, and FIG. 7, various axial positions of the curette 102 on the grinding wheel 140 are shown. FIG. 5 shows the proper position 228 of the instrument 102 on grinding wheel 140. FIG. 6, depicts an improper counterclockwise, axial position 230 for curette 102, which results in improper sharpening. Likewise FIG. 7 depicts an improper clockwise, axial position 232 which also provides for improper sharpening. It is critical that this correct position 228 be achieved.

In FIG. 8, a scissors clamp 300 can replace clamp 134 and provide a great deal of flexibility for device 100, while clamping an instrument 102 therein. Scissors clamp 300 includes a slot 302 for holding the instrument. Slot 302 receives a handle 103 of an instrument 102 therein. Slot 302 is a trenchlike affair of a rectangular solid having a semicylindrical slot therealong for receiving the handle 103 of the instrument 102.

Slot 302 includes a pair of mounting pins 304 for mounting in the instrument arm 133 of device 100. The instrument 102 is held in the clamp by a scissors mechanism having a fixed handle 310 and a movable handle 312. Moveable handle 312 is mounted in a handle block 314.

Handle block 314 includes a fixed block 316 having fixed handle 310 fixed thereon. Within handle block 314 is a longitudinal slot 324 for receiving an opposing hinged end 320 of movable handle 312. Movable handle 312 includes a movable aperture 313 for receiving a digit (not shown) of an operator for the device 100. Situated in hinged end 320 of movable handle 312 is a hinge pin 322 which fits movably in vertical slot 318 of block 314. An elastic member 326 wraps around the block 314 and flexibly holds the hinge pin 322 in the vertical slot 318.

Fixed handle 310 has fixed end 330 secured to fixed block 316 and fixed aperture 332 oppositely disposed therefrom. Situated between fixed end 330 and fixed aperture 332 are fixed teeth 334. Movable handle 312 has moveable teeth 336 situated between in hinged end 320 and movable aperture 313. Fixed teeth 334 and movable teeth 336 mesh and lock an instrument 102 in slot 302 in a ratchet type mechanism 338.

Situated between the movable aperture 313 and handle block 314, and over the slot 302 is a rubber grommet 340 capable of holding instrument 102 in slot 302. This is especially true when the instrument 102 is clamped therein by virtue of the ratchet mechanism 338 and the grommet 340. The instrument 102 is separated therefrom by causing the ratchet mechanism 338 to separate and release.

When considering FIG. 9, the squeeze clamp 360 provides a great deal of flexibility and is the preferred method for clamping an instrument 102 in the device. The squeeze clamp 360 can be operated with one hand and is easily released. Again the hinge pin 322 and the elastic member 326 hold the instrument 102 in slot 302.

The squeeze clamp 360 includes an upper movable lever 362 and a lower fixed lever 364 capable of being squeezed together. By so squeezing together the clamp teeth 366 lock to the block teeth 368 and cause the instrument 102 to be fastened therein.

The upper movable lever 362 includes flexible handle 372 having an upper bar 374 and a lower bar 376. By squeezing upper bar 374 toward lower bar 376, the clamp teeth 366 release from the block teeth 368 and cause the instrument 102 to be released therefrom.

Common to both the squeeze clamp 360 and the scissors clamp 300 of FIG. 8 and FIG. 9 is the elastic member 326 and rubber mounting grommet 340 for holding an instrument 102 in either clamping device. The rubber mounting grommet 340 fits around the handle 103 of a dental instrument 102. With the rubber mounting grommet 340, the clamping device can lock and hold the instrument in place.

FIG. 10 depicts a pinned rubber mounting grommet 380 with a precision index pin 382 protruding therefrom. If an instrument 102 has an appropriate precision instrument pin aperture 384 for receiving the precision index pin 382 therein positioned properly on the handle thereof, the positioning guides 160 and 162 on sharpening device 100 can be eliminated. The pinned and clamped instrument 102 can then proceed directly to the wheel 140 for sharpening. A particular location of the pin aperture 384 on the instrument combined with the pin 382 and the rubber grommet 380 permits the correct positioning of the instrument 102 so that it may be properly sharpened.

The key matter is to use the precision index pin 382 to cooperate with precision instrument pin aperture 384 and either clamp to lock the instrument 102 into place in the longitudinal and axial dimensions as discussed previously. With the movement of the mounting clamp in the horizontal and vertical directions, the instrument 102 can be sharpened on the grinding wheel 140 after being positioned and locked in the clamp. With this structure and the index pin 382, the proper position of the instrument 102 for sharpening is consistently reproduced. By using pin 382 and precision instrument pin aperture 384, both first positioning guide 160 and second positioning guide 162 become optional or eliminable.

Referring now to FIG. 11, a small handled instrument 400 is held by the rubber grommet 380. In FIG. 12, the larger handled instrument 410 is held because the grommet 380 holds it and the larger handled instrument 410 forces flanges 392 outwardly. The grommet 380 is basically a flanged cylindrical member having a central cylindrical portion 390 substantially surrounding the movable arm while at the same time having flanges 392 extending therefrom and achieving the desired holding mechanism. In this fashion, the desired results can be easily obtained. The clamping action combined with the pin 382 and the rubber grommet 380 permits the correct positioning of the instrument 102 so that it may be sharpened.

The grinding wheel 140 is generally about 5.1 centimeters (two inches) in diameter, and is generally of the powderless type known as a jeweler's wheel. Any suitable grinding wheel 140 may be used, so long as it shows substantially no wear or the wear does not affect the sharpening angle. Typically the grinding wheel 140 is available from the Charles Dvorkin Company of Chicago, Ill.

The electric motor 130 is a typical motor. It may be, but is not required to be, especially suitable for use in medical systems. The standard belt 131 is used to drive from the drive pulley of electric motor 130 to the grinding wheel pulley and spin the grinding wheel 140 as desired. It is also permitted to have a chain drive or direct drive of the grinding wheel 140. However, this belt 131 structure is preferred.

For example, an instrument 102 called a 13/14 Gracey curette has a certain angle thereon. This angle is actually a standard angle for this instrument 102. Each instrument 102 has a recorded, certain position on either first positioning guide 160 or second positioning guide 162 for each instrument blade 200, where the lateral surface needs to be placed for positioning.

The positions are arbitrary due to the fact that the whole idea is that each design of instrument 102 needs its own particular placement in the clamp to be properly sharpened on the grinding wheel 140. Usually, the instruments are operated with a pulling action. Device 100 is especially suitable for sharpening those instruments.

A sickle, as an example of instrument 102, is placed, before it is sharpened, in the clamp, then aligned right on top of that empirically determined point for the sickle, and, while so aligned as a tangent of that predetermined position of that semicircular first positioning guide 160 or second positioning guide 162, secured in the clamp. The sickle, then while locked in position, is then brought over to and sharpened on the grinding wheel 140 or disk.

The whole idea is that everything related to sharpening each instrument 102 is standard as to position. This method produces a very precise and very systematic way of sharpening any instrument 102 as opposed to doing it by hand. The device 100 of this invention avoids so much error involved and greatly reduces the time to sharpen an instrument 102.

The first priority in sharpening a dental instrument 102 is to set up in a well lighted area using a high intensity lamp or the light from a dental unit. With the specific sharpening position for an instrument 102 determined by either first measuring device 160 or second measuring device 162; or the combination of the precision index pin 382, precision instrument pin aperture 384 and the pinned rubber mounting grommet 380 the required dexterity for sharpening instrument 102 is greatly reduced.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modifications of this method and apparatus can become clear to a person having ordinary skill in this particular art. Such modifications are clearly covered by this disclosure.

What is claimed and sought to be protected by Letters Patent of the United States is:

1. A method for accurately sharpening chiral blades of a dental instrument, the method comprising the steps of:

providing positioning guide means having empirically determined indicia thereon for positioning the dental instrument in a desired predetermined position;

determining a sharpening position for at least one of the chiral blades of the dental instrument by placing the dental instrument in a movable instrument holding means and placing the at least one of the chiral blades in tangential contact with said positioning indicia;

securing the dental instrument in said instrument holding means;

moving said instrument holding means to a rotating sharpening stone; and placing the at least one chiral blade in contact with said sharpening stone.

2. A sharpening device for accurately sharpening both chiral blades of a dental instrument, the device comprising:

housing means adapted to hold a rotatable sharpening stone and further defining a left portion and a right portion, each portion further including:

dental instrument holding means for securing one of the chiral blades in a predetermined longitudinal and axial position;

positioning guide means, in operative proximity with said dental instrument holding means, having empirically determined indicia thereon representing a tangential position between the at least one chiral blade and said positioning guide means to facilitate repetitive positioning of said at least one of the chiral blades in said predetermined longitudinal and axial position to facilitate repetitive positioning of the one of the chiral blades in said predetermined longitudinal and axial position; and said dental instrument holding means also being adapted for horizontally moving the at least one chiral blade between said indicia on said positioning guide means and said rotatable sharpening stone and for facilitating vertical placement of the at least one chiral blade in desired contact with said sharpening stone.

3. The device of claim 2 wherein said housing includes a base and guidance platform thereabove wherein the guidance platform has a grinder slot for receiving said rotatable sharpening stone and said positioning means in each left and right portion are fixed to a top surface of said guidance platform such that at least a portion of said rotatable sharpening wheel lies between said positioning means.

4. The device of claim 3 wherein said dental instrument holding means in each of said left and right portions includes clamping means at an end thereof for releasably holding said dental instrument in said predetermined position.

5. The device of claim 4 wherein said positioning guide means in each of said left and right portions is comprised of a semicylindrical guide having graduated indicia thereon.

* * * * *

UNITED STATES PATENT AND TRADEMARK OFFICE

CERTIFICATE OF CORRECTION

PATENT NO. : 5,331,774

DATED : July 26, 1994

INVENTOR(S) : David D. Domenella

It is certified that error appears in the above-indentified patent and that said Letters Patent is hereby corrected as shown below:

In column 3, lines 58-59, delete "exploration" and insert --explanation--.

In column 4, lines 6-7, delete "surfaces" and insert --surface--.

In column 4, line 15, after "other" insert --and--.

In column 4, line 46, delete "y" and insert --of--.

In column 6, line 33, delete "126K" and insert --126R--.

In column 6, line 42, delete "slid ably" and insert --slidably--.

In column 6, line 54, delete "162" first occurrence and insert --160--.

UNITED STATES PATENT AND TRADEMARK OFFICE

CERTIFICATE OF CORRECTION

PATENT NO. : 5,331,774

DATED : July 26, 1994

INVENTOR(S) : David D. Domenella

It is certified that error appears in the above-indentified patent and that said Letters Patent is hereby corrected as shown below:

In column 7, line 24, delete "positioning" and insert --pivoting--.

In column 7, line 25, delete "122L" and insert --126L--.

In column 8, line 12, delete "the horizontal movement thereof".

Signed and Sealed this

Thirtieth Day of May, 1995

*Attest:*

*Attesting Officer*

BRUCE LEHMAN

*Commissioner of Patents and Trademarks*